US006932301B2

(12) United States Patent
Green

(10) Patent No.: US 6,932,301 B2
(45) Date of Patent: Aug. 23, 2005

(54) BUCKLE FOR KITES AND THE LIKE

(76) Inventor: Rollin Green, 41500 Ortega Hwy., San Juan Capistrano, CA (US) 92675

( * ) Notice: Subject to any disclaimer, the term of this patent is extended or adjusted under 35 U.S.C. 154(b) by 0 days.

(21) Appl. No.: 10/643,821

(22) Filed: Aug. 19, 2003

(65) Prior Publication Data

US 2005/0040292 A1 Feb. 24, 2005

(51) Int. Cl.[7] ..... B64C 31/06
(52) U.S. Cl. ..... 244/155 A
(58) Field of Search ..... 244/153 R–155 A

(56) References Cited

U.S. PATENT DOCUMENTS

| | | | | | |
|---|---|---|---|---|---|
| 2,425,309 | A | * | 8/1947 | Ennis | 280/504 |
| 2,464,720 | A | * | 3/1949 | Rose | 244/155 R |
| 2,484,096 | A | * | 10/1949 | Murray | 244/153 R |
| 2,931,231 | A | * | 4/1960 | Felix | 74/2 |
| 3,088,701 | A | * | 5/1963 | Fricke | 244/155 R |
| 4,452,161 | A | * | 6/1984 | McCoy | 114/39.18 |
| 4,557,439 | A | | 12/1985 | Puskas | 244/63 |
| 5,072,899 | A | * | 12/1991 | Nickle | 244/155 R |
| 6,145,789 | A | * | 11/2000 | Matlin et al. | 244/153 R |
| 6,508,186 | B2 | | 1/2003 | Veh | 114/39.18 |
| 6,513,759 | B2 | | 2/2003 | Starbuck | 244/155 A |
| 6,640,397 | B1 | * | 11/2003 | Gipson | 24/191 |
| 2002/0088686 | A1 | | 7/2002 | Veh | 114/39.18 |
| 2003/0042366 | A1 | * | 3/2003 | Britt et al. | 244/153 R |
| 2003/0116071 | A1 | * | 6/2003 | Starbuck | 114/39.13 |

FOREIGN PATENT DOCUMENTS

| | | |
|---|---|---|
| DE | 2835579 | 2/1980 |
| DE | 2545081 | 4/1980 |
| GB | 2115684 | 9/1983 |

* cited by examiner

*Primary Examiner*—Galen Barefoot
(74) *Attorney, Agent, or Firm*—The Halvorson Law Firm

(57) ABSTRACT

Described is a device that releaseably couples a person to kites and other like sports equipment. The device for coupling to kites and other like sports equipment comprises a releasable hook mechanism attached to a spreader bar, said releasable hook mechanism comprising a releasable hook pivotally attached to a body that attached to the spreader bar, said releasable hook pivotally movable from a closed position to an open position. The releasable hook, preferably, is resiliently biased from the closed position to the open position. The device may further comprise a release plate mechanism that releasably holds the rotatable hook in the closed position. Additionally, the device may further comprise a release defeat mechanism that prevents release of the rotatable hook by the release plate mechanism. Finally, the device may further comprise a rotating safety lease attachment ring that is rotatingly attached to the body of the device.

15 Claims, 7 Drawing Sheets

BUCKLE FOR KITES AND THE LIKE

FIELD OF THE INVENTION

The present invention relates to the field of buckles for coupling to kites and other like sports equipment. More specifically, the present invention relates to the field of buckles that couple to kites and other likes sports equipment and provides for emergency release of the same.

BACKGROUND

There have been a number of deaths in the extreme sport of kite surfing. The primary cause of these deaths is due to the fact that the participants, who were connected to very powerful kites, were dragged or lofted into hard objects and killed. This unfortunate occurrence may happen to experienced and expert kiters as well as neophytes. An example of this danger is when a user is still attached to the kite and a gust of wind lofts the kite, and user, 20–30 feet in the air. This can move the user as much as 300 feet horizontally in a very quick time.

A typical 4-line kite has a control bar that has control lines extending to the like canopy. Sidelines attached to respective bars go to the side trailing tips of the kite and a centerline that is not attached to the respective bars, but to the rider's hook and both forward lines that go to side leading edge tips of the kite. If the control bar is lowered or raised by the rider so that the sidelines on the bar are pulled down or released relative to the centerline, the angle at which the canopy passes through the air is reduced or increased (referred to as "angle of attack" in aviation terms) which reduces or increases the lifting force. This in turn increases or decreases the effective power generated by the kites. It is known that the control bar may be attached via this center line "trim" loop located through a hole in the control bar to a hook attached to the rider's harness.

The rider holds the control bar in his hands. If unintentionally launched unhooked the rider merely releases the bar, flattening out the angle of attack of the kite, and thereby reducing lift power. For safety and control reasons, once aloft and in control of the kite, and away with adequate distance from hard objects, the rider should hook himself to the kite.

Another commonly used connection to the kite is called a shackle. These are produced for the sailboat industry and are currently being used by kiters to shackle themselves to the kite prior to launching it. The problem here develops when the kiter is lofted on launching and has to grope for his "release" and can't just let go of the bar to detach himself from the powered up kite.

As mentioned briefly above, most of the hooks attached to the harness or spreader bar have no release mechanism, which tempts fate in that there is no way to extract oneself if accidentally launched by a gust of wind. This problem is further exasperated by the fact that the movement required to unhook the rider is to pull the control bar toward the rider, the same movement that increases the angle of attack of the kite thereby increasing power. Currently any other hooks that release are unreliable, do not release 100% of the time, or bind the loop they are releasing, or do not release under significant load and are not resetable without the use of both hands.

Thus, there is clearly a need for a releasable hook for kites and other like sports equipment that provides for easy and safe emergency release and reset of a hook from a kite or other like sports equipment.

Once released the hook must be easily resetable by the kiter. The hook is the only way the kiter can control the power of the kite to ride, and therefore his only means of returning safely to the beach. When the kite is either flying or down on the water it is pulling on the rider. It is difficult to do anything with more than one hand while the other hand is controlling the kite. A released hook must be readily reset to make it a functioning asset to the rider.

SUMMARY OF INVENTION

It is an object of the present invention to provide a device for coupling to kites and other like sports equipment comprising a releasable hook mechanism attached to a spreader bar, said releasable hook mechanism comprising a releasable hook pivotally attached to a body that attached to the spreader bar, said releasable hook pivotally movable from a closed position to an open position.

It is another object of the present invention to provide the device above wherein the releasable hook is resiliently biased from the closed position to the open position.

It is yet another object of the present invention to provide the device above farther comprising a release plate mechanism that releasably holds the rotatable hook in the closed position.

It is a further object of the present invention to provide the device above further comprising a release defeat mechanism that prevents release of the rotatable hook by the release plate mechanism.

It is yet a further object of the present invention to provide the device above further comprising a rotating safety lease attachment ring that is rotatingly attached to the body of the device.

It is still yet a further object of the present invention to provide a method for coupling to kites and other like sports equipment comprising the steps of providing a releasable hook mechanism attached to a spreader bar, said releasable hook mechanism comprising a releasable hook pivotally attached to a body that attached to the spreader bar, said releasable hook pivotally movable from a closed position to an open position.

It is still a further object of the present invention to provide a method for coupling and uncoupling to kites and other like sports equipment comprising the steps of attached lines to a releasable hook mechanism attached to a spreader bar, said releasable hook mechanism comprising a releasable hook pivotally attached to a body that attached to the spreader bar, said releasable hook pivotally movable from a closed position to an open position, when the releasable hook is in the closed position, and, afterwards, allowing the releasable hook to pivotally move from the closed position to the open position thereby releasing any attached lines.

The novel features that are considered characteristic of the invention are set forth with particularity in the appended claims. The invention itself, however, both as to its structure and its operation together with the additional object and advantages thereof will best be understood from the following description of the preferred embodiment of the present invention when read in conjunction with the accompanying drawings. Unless specifically noted, it is intended that the words and phrases in the specification and claims be given the ordinary and accustomed meaning to those of ordinary skill in the applicable art or arts. If any other meaning is intended, the specification will specifically state that a special meaning is being applied to a word or phrase. Likewise, the use of the words "function" or "means" in the Description of Preferred Embodiments is not intended to indicate a desire to invoke the special provision of 35 U.S.C. §112, paragraph 6 to define the invention. To the contrary, if the provisions of 35 U.S.C. §112, paragraph 6, are sought to be invoked to define the invention(s), the claims will specifically state the phrases "means for" or "step for" and a function, without also reciting in such phrases any structure, material, or act in support of the function. Even when the claims recite a "means for" or "step for" performing a function, if they also recite any structure, material or acts in support of that means of step, then the intention is not to invoke the provisions of 35 U.S.C. §112, paragraph 6. Moreover, even if the provisions of 35 U.S.C. §112, paragraph 6, are invoked to define the inventions, it is intended that the inventions not be limited only to the specific structure, material or acts that are described in the preferred embodiments, but in addition, include any and all structures, materials or acts that perform the claimed function, along with any and all known or later-developed equivalent structures, materials or acts for performing the claimed function.

DETAILED DESCRIPTION OF PREFERRED EMBODIMENTS

Figure 1:
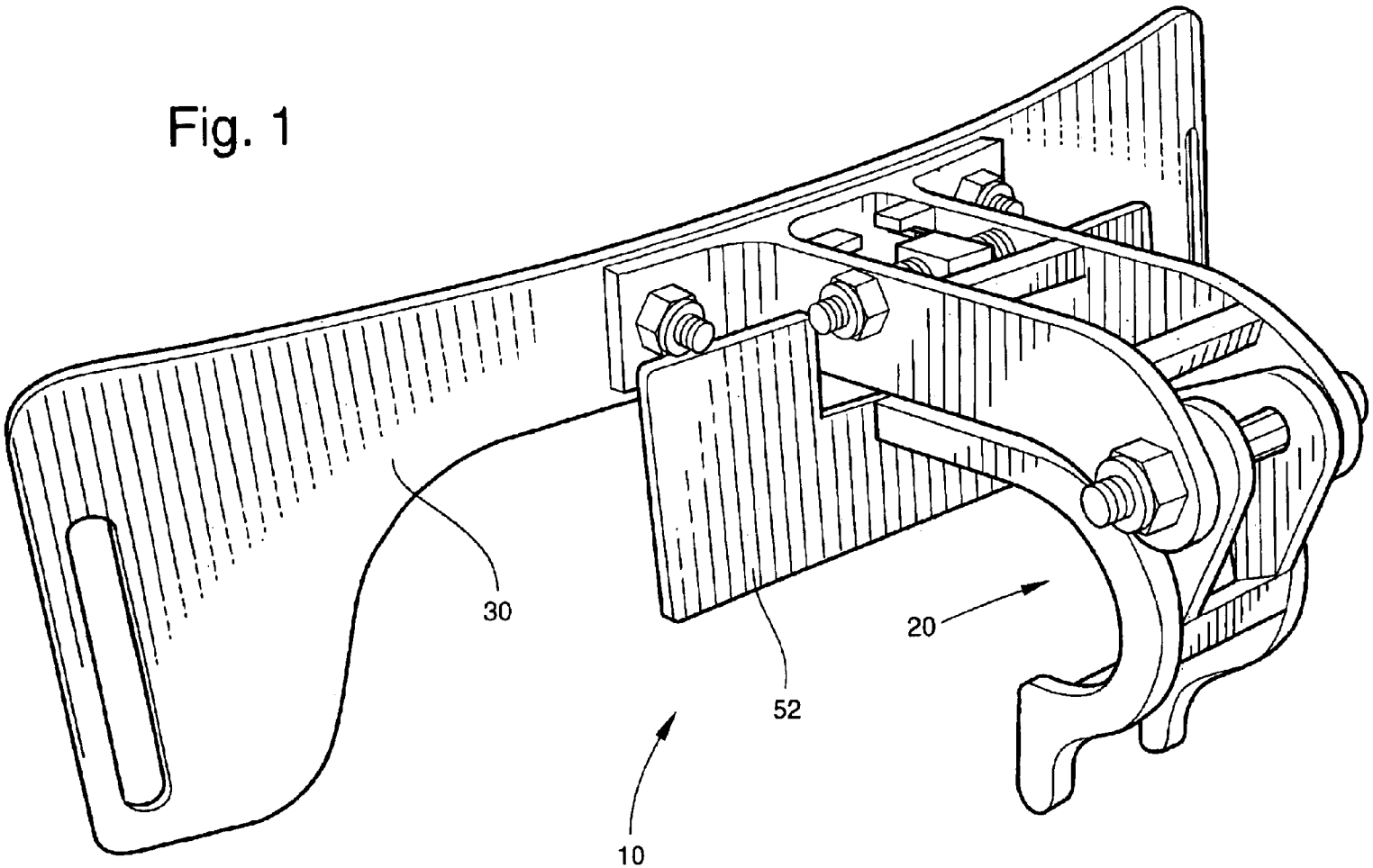
FIG. 1 is a perspective view of the buckle according to the present invention.
Figure 2:
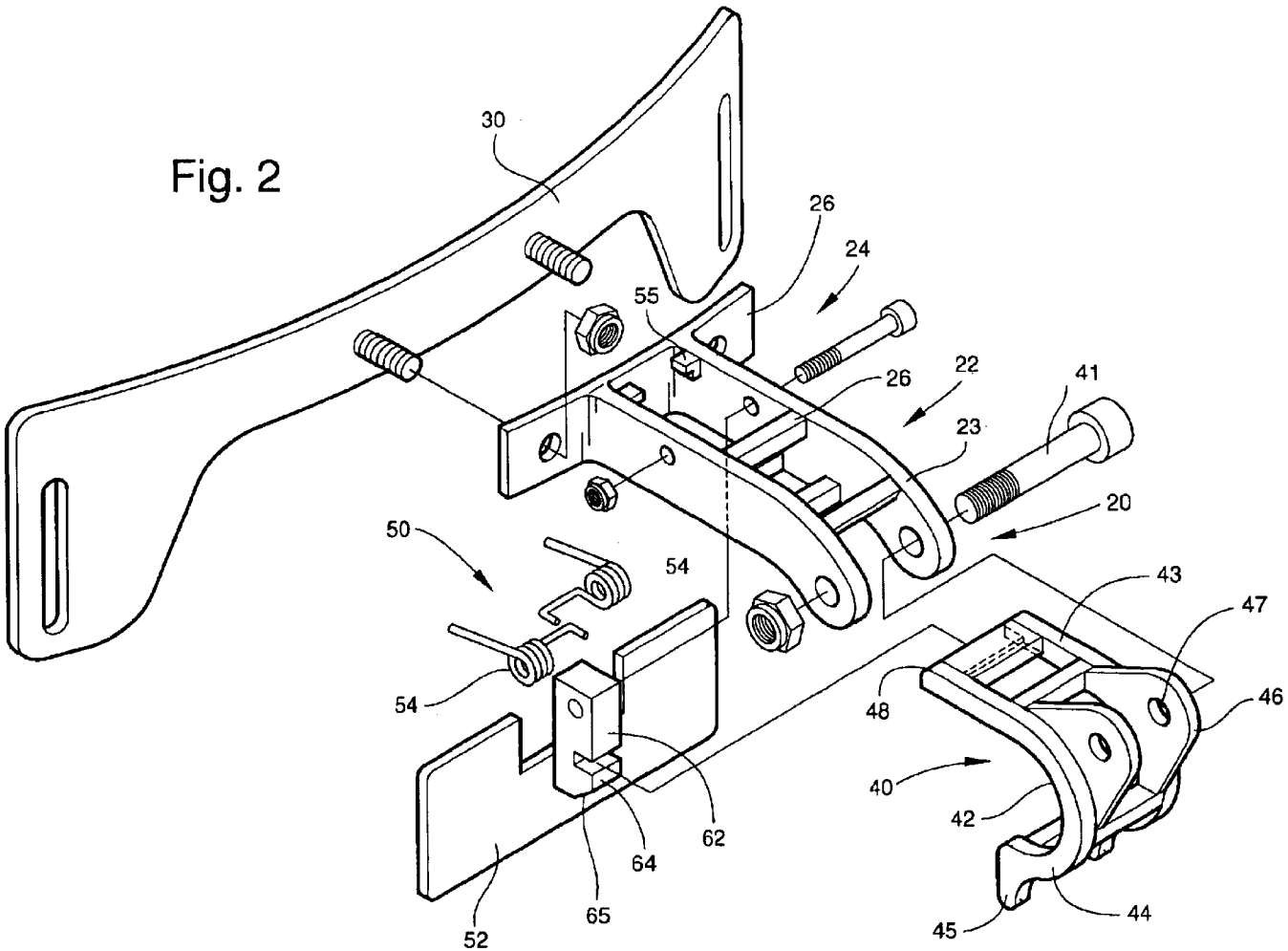
FIG. 2 is an exploded view of one embodiment according to the present invention.
Figure 3:
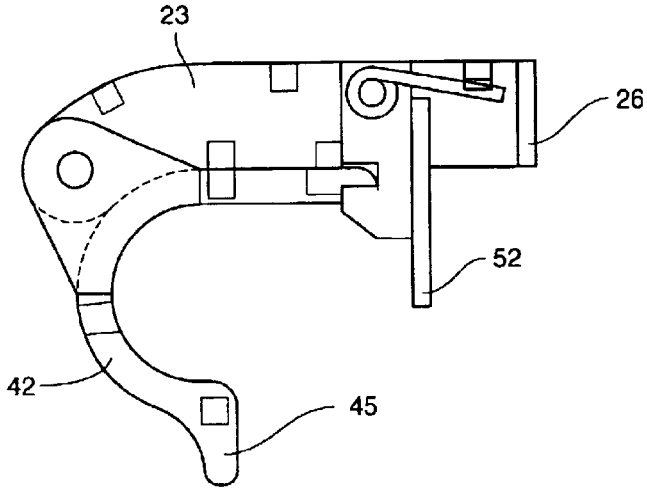
FIG. 3 is a side view of the buckle according to the present invention illustrating a latched position.
Figure 4:
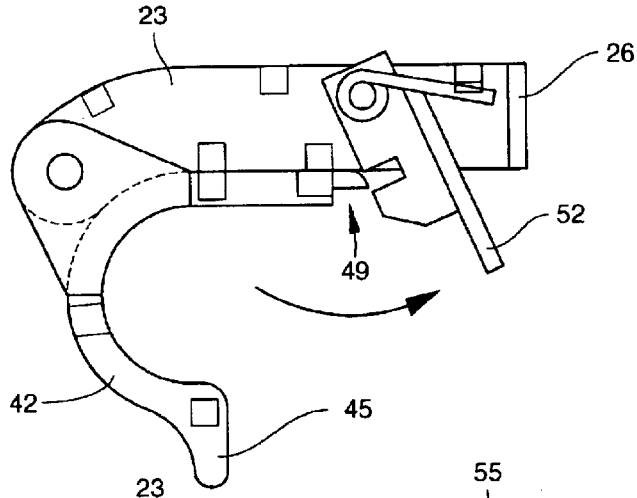
FIG. 4 is a side view of the buckle according to the present invention illustrating an unlatching action.

The present invention is a device 10 useful for coupling to kites and other like sports equipment.

The device 10 according to the present invention comprises a releasable hook mechanism 20 attached to a spreader bar 30 (or other like base system).

Generally, in one preferred embodiment of the device 10 according to the present invention, the releasable hook mechanism 20 comprises a body 22 of at least one projecting portion 23, preferably two, that attaches at a first end 24 to a spreader bar 30 and has a hook pivot axis at a second end 25. The body 22 attaches to the spreader bar 30 via an attachment base 26. The slots in the end of the spreader bar 30, are positioned in line with a horizontal pull from the center of the hook when latched to prevent the pull from rotating the spreader bar 30. A rotatable hook 42 is pivotally attached to the body 22 at a hook pivot axis, preferably by a pin 41 or other like structure, which is located at the second end 25 of each projecting portion 23. When there are two or more projecting portions 23 in the body 22, there will be at least one transverse support 26 engaging the more than one projecting portions 22 and providing needed structural support and rigidity. In the preferred embodiment, the second end 25 of the projecting portions 23 is curved away from the major axis of the projecting portions 23.

Located in or on the body 22 at a location intermediate the curved second end 25 and the attachment base 26 is a release push plate pivot mechanism 50. This release push plate pivot mechanism 50 allows a pivotally attached release push plate 52 to pivot about an axis perpendicular to the major axis of the body 22. Preferably, at least one first return biasing structure 54, such as a spring or the like, is attached to a pivot axis and engages a biasing stop 55 located adjacent the attachment base 26.

Figure 5:
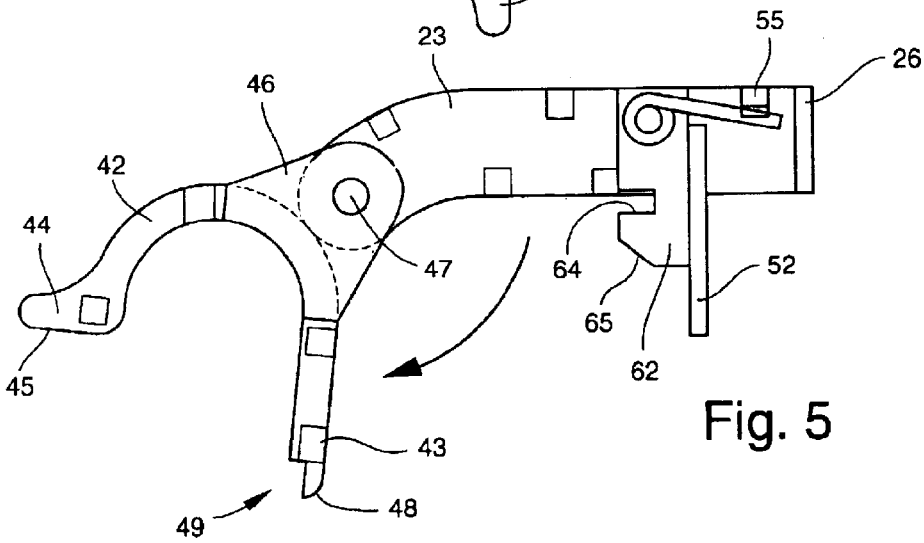
FIG. 5 is a side view of the buckle according to the present invention illustrating an unlatched position.
Figure 6:
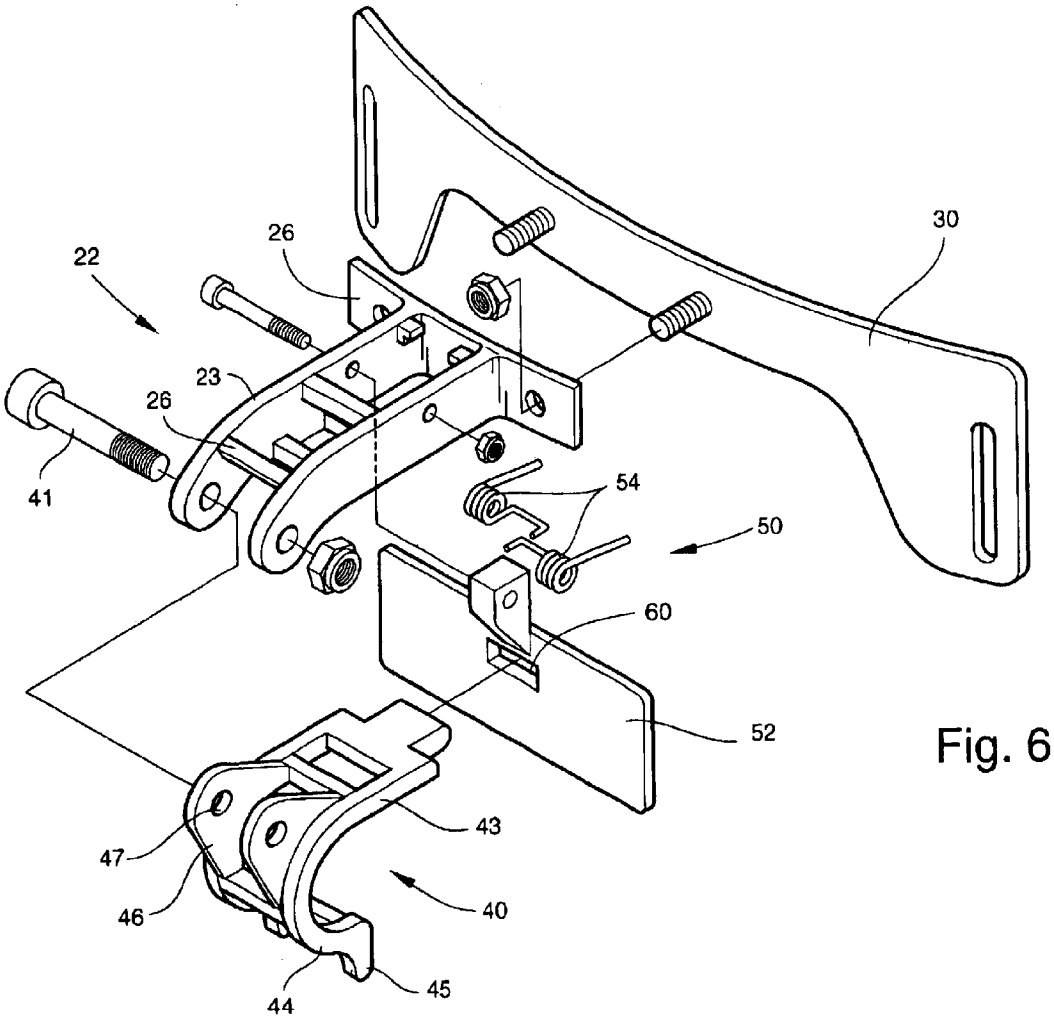
FIG. 6 is an exploded view of a second embodiment according to the present invention.
Figure 8:
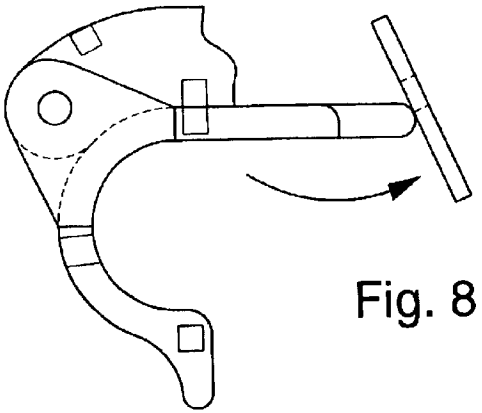
FIG. 8 is a side view of the second embodiment according to the present invention illustrating an unlatching action.
Figure 7:
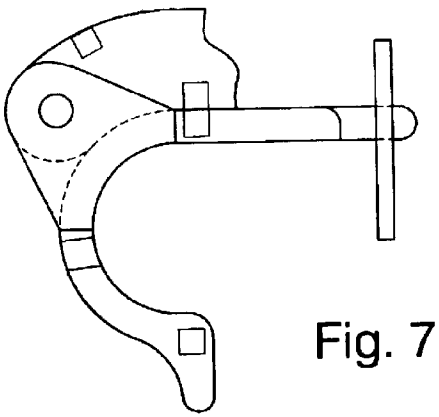
FIG. 7 is a side view of the second embodiment according to the present invention illustrating a latched position.
Figure 9:
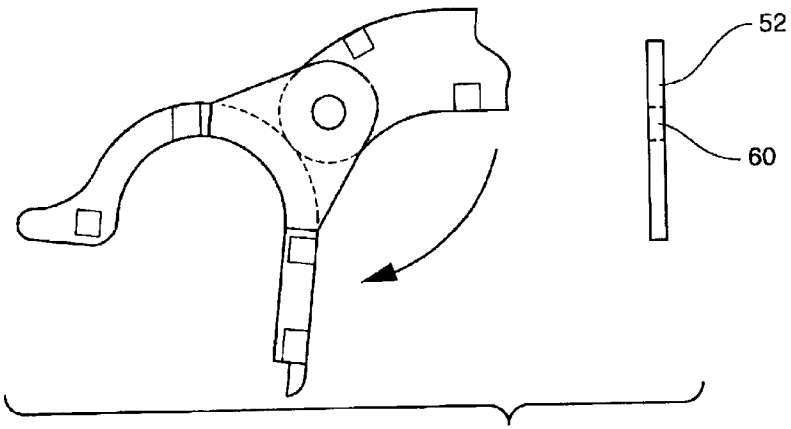
FIG. 9 is a side view of the second embodiment according to the present invention illustrating an unlatched position.
Figure 10:
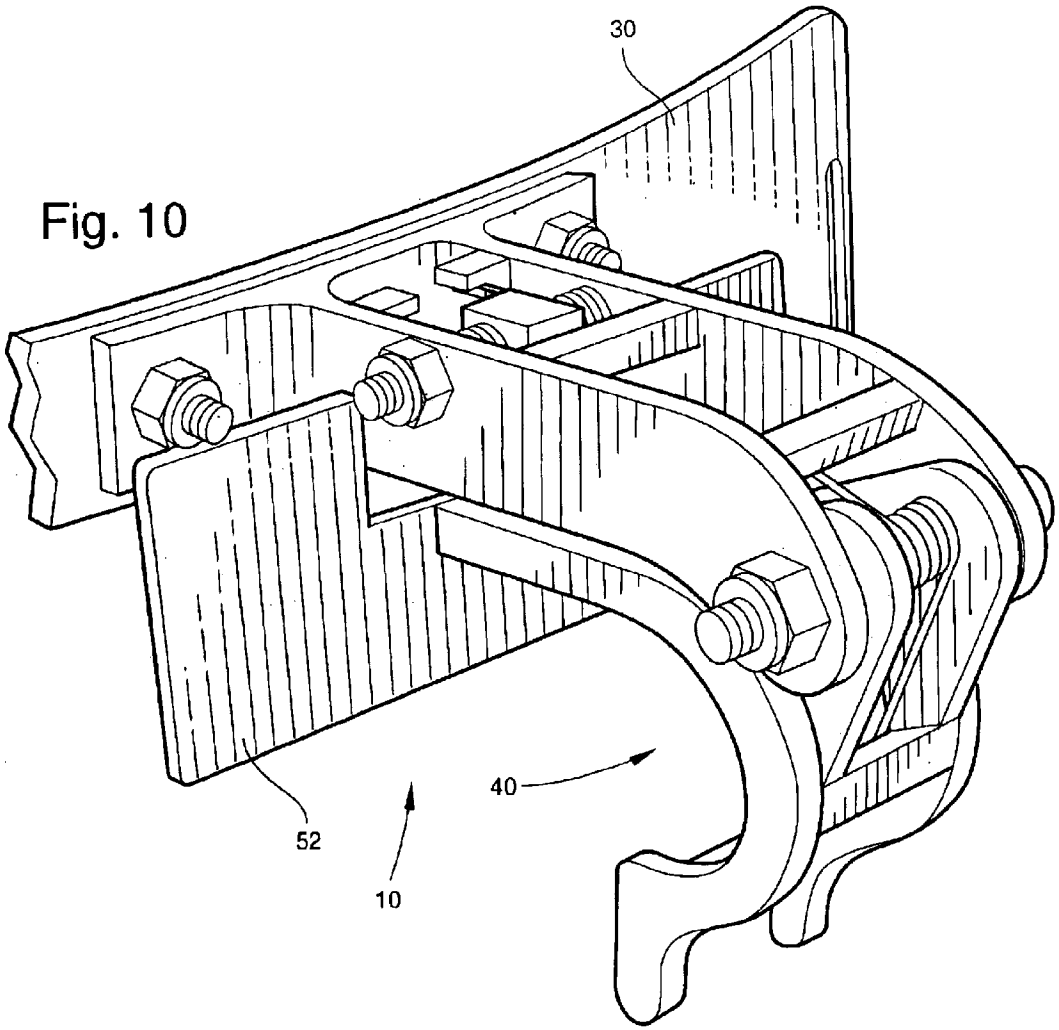
FIG. 10 is a perspective view of the second embodiment according to the present invention.

The rotatable hook 42, according to the present invention, is comprised of a wide hook structure having a substantially J-shaped outline. The hook structure has a first end 43 (the long arm of the J shape) and a second end 44 (the short arm of the J shape). The distal end of the second end 44 includes a tab 45, which is provided to aid in forcing the rotatable hook 42 from an open position to a closed position. Located on an outer side of the cup of the J shape is at least one pivot tab 46 having at lease one pivot aperture 47 per pivot tab. The distal end of the first end 43 of the hook structure may include a curved or beveled edge 48. In a preferred embodiment, the distal end of the first end 43 of the hook structure may further include a locking notch 49 adjacent the curved edge 48 for engaging the release push plate 52. As in FIG. 5, the pivot aperture 47 is located inferior to the main body 22 of the release. This offset allows the hook to be thrown open, completely releasing any attached lines, even if the pull is in a horizontal direction.

When mounted on the body 22, the rotatable hook 42 is resiliently biased, such as by a spring or other like mechanism, to an open position. The rotatable hook 42 may be positioned into a closed position by overcoming the resilient bias force. The rotatable hook 42 is locked into position by engaging the first end 43 of the rotatable hook 42 with a release push plate 52.

There are several different, but equivalent, structures to lock the rotatable hook 42 to the release push plate 52. One embodiment is a simple cut-out 60 in the release push plate 52 where the first end 43 of the rotatable hook 42 is inserted into the cut-out 60. Insertion of the rotatable hook 42 is accomplished by overcoming the resilient bias of the rotatable hook mechanism. 40 and the resilient bias of the release push plate mechanism 50. The rotatable hook 42 is released from the closed position by pressing the release plate 52 with sufficient force to overcome the resilient bias of the release plate mechanism 50. In another embodiment, in place of the cut-out 60, there may be an attached tang 62 having a ledge 64 that catches and retains the first end 43 of the rotatable hook 42. This ledge 64, preferably, has a slanted edge 65 in order to aid in overcoming the biasing force of the release plate mechanism 50 when resetting the hook.

Figure 11:
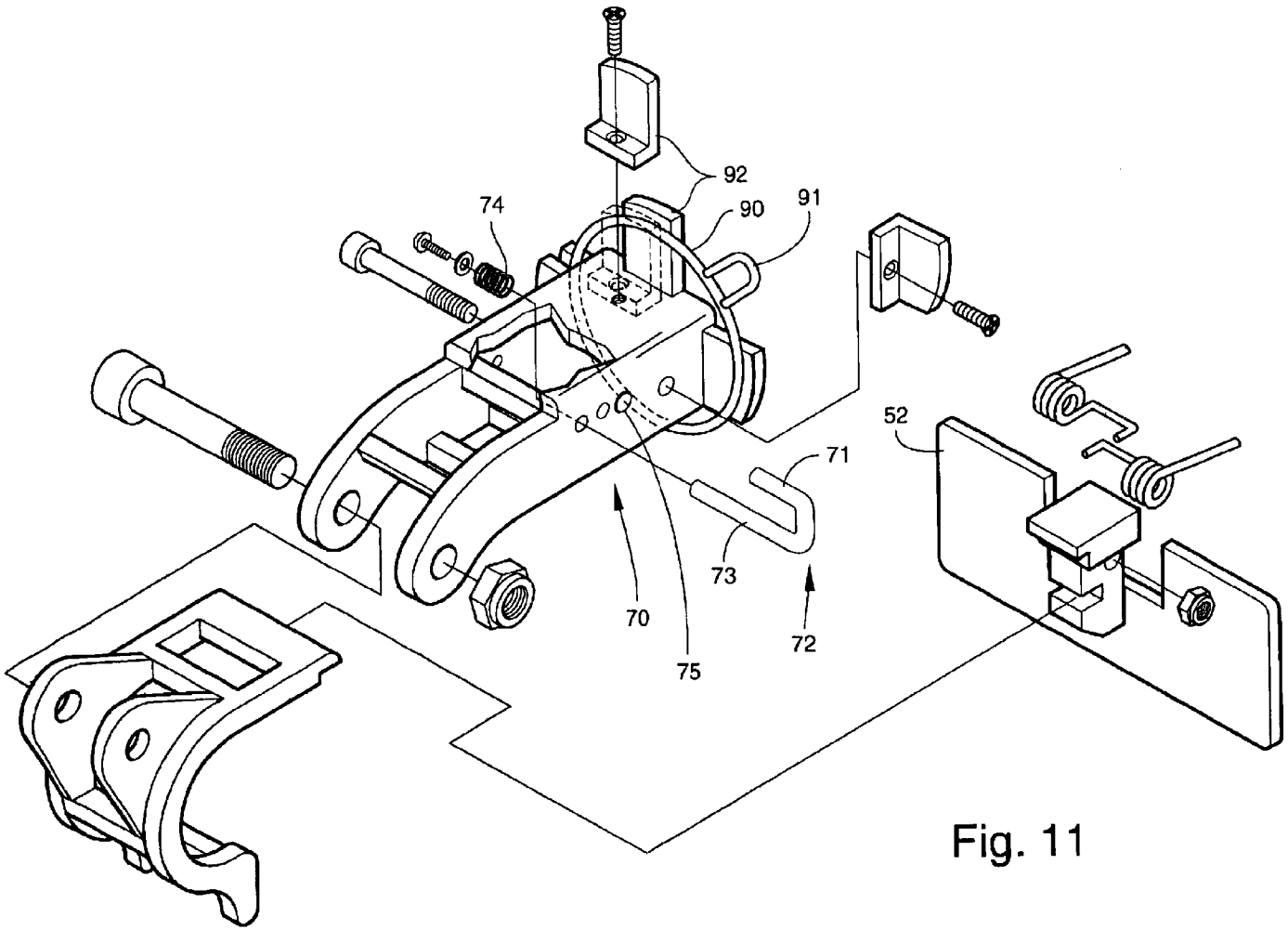
FIG. 11 is an exploded view of a third embodiment of according to the present invention.

Additionally, as illustrated in FIG. 11, for instances when it is desired to prevent unwanted release, the device 10 according to the present invention may also include a release defeat mechanism 70. The release defeat mechanism 70 is a structure that prevents unwanted activation of the release push plate 52. Accordingly the release defeat mechanism 70, according to the preferred embodiment, comprises a J-shaped pin 72 that is resiliently biased by a set of springs 74 located at an end of the long leg 73 of the J-shaped pin 72. Accordingly, the J-shaped pin 72 may be pulled against the resilient biasing and rotated from a first position to a second position (one position allows the release push plate 52 to be activate while the other position prevents unwanted activation of the release push plate 52). The short leg 71 of the J-shaped pin, when in the release defeat position, fits within an aperture 75 located adjacent either the release push plate 52 or the attached tang 62. In this position, the J-shaped pin 72 blocks unwanted activation of the release push plate 52 until it is returned to the non-blocking position. Alternate forms of the release defeat mechanism 70 may be used with the instant invention and still fall within the scope the claims.

Finally, the device 10 according to the present invention may include a rotating safety leash attachment ring 90 that is rotatingly attached adjacent to the base 26 or in front of the release push plate 52. The rotating safety leash attachment ring 90 is a circular ring and usually has a leash attachment loop 91 attached thereto. The rotating safety leash attachment ring 90 is maintained in position by at least one, preferably three, ring tang pairs 92. Each ring tang pair 92 is spaced apart sufficient to allow substantially free rotation of the rotating safety leash attachment ring 90. The ends of the ring tang pairs 92 reach only to the perimeter of the rotating safety leash attachment ring 90 thereby allowing the leash attachment loop 91 unhindered rotational access. Alternate structures to maintain the position of the rotating safety leash attachment ring 90 may be used, but still fall within the scope of the present invention.

The preferred embodiment of the invention is described above in the Drawings and Description of Preferred Embodiments. While these descriptions directly describe the above embodiments, it is understood that those skilled in the art may conceive modifications and/or variations to the specific embodiments shown and described herein. Any such modifications or variations that fall within the purview of this description are intended to be included therein as well. Unless specifically noted, it is the intention of the inventor that the words and phrases in the specification and claims be given the ordinary and accustomed meanings to those of ordinary skill in the applicable art(s). The foregoing description of a preferred embodiment and best mode of the invention known to the applicant at the time of filing the application has been presented and is intended for the purposes of illustration and description. It is not intended to be exhaustive or to limit the invention to the precise form disclosed, and many modifications and variations are possible in the light of the above teachings. The embodiment was chosen and described in order to best explain the principles of the invention and its practical application and to enable others skilled in the art to best utilize the invention in various embodiments and with various modifications as are suited to the particular use contemplated.

What is claimed is:

1. A device for coupling to kites and other like sports equipment comprising a releasable hook mechanism, which is designed to indirectly attach to a kite, attached to a spreader bar, which is designed to attach directly to a kite user, said releasable hook mechanism comprising a releasable hook pivotally attached to a body that attached to the spreader bar, said releasable hook pivotally movable from a closed position to an open position.

2. The device according to claim 1 wherein the releasable hook is resiliently biased from the closed position to the open position.

3. The device according to claim 2 further comprising a release plate mechanism that releasably holds the rotatable hook in the closed position.

4. The device according to claim 3 further comprising a release defeat mechanism that prevents release of the rotatable hook by the release plate mechanism.

5. The device according to claim 4 further comprising a rotating safety release attachment ring that is rotatingly attached to the body of the device.

6. A method for coupling to kites and other like sports equipment comprising the steps of providing a releasable hook mechanism, which is designed to indirectly attach to a kite, attached to a spreader bar, which is designed to attach directly to a kite user, said releasable hook mechanism comprising a releasable hook pivotally attached to a body that attached to the spreader bar, said releasable hook pivotally movable from a closed position to an open position.

7. The method according to claim 6 wherein the releasable hook is resiliently biased from the closed position to the open position.

8. The method according to claim 7 further comprising a release plate mechanism that releasably holds the rotatable hook in the closed position.

9. The method according to claim 8 further comprising a release defeat mechanism that prevents release of the rotatably hook by the release plate mechanism.

10. The method according to claim 9 further comprising a rotating safety release attachment ring that is rotatingly attached to the body of the device.

11. A method for coupling and uncoupling to kites and other like sports equipment comprising the steps of attached lines to a releasable hook mechanism, which is designed to indirectly attach to a kite, attached to a spreader bar, which is designed to attach directly to a kite user, said releasable hook mechanism comprising a releasable hook pivotally attached to a body that attached to the spreader bar, said releasable hook pivotally movable from a closed position to an open position, when the releasable hook is in the closed position, and, afterwards, allowing the releasable hook to pivotally move from the closed position to the open position thereby releasing any attached lines.

12. The method according to claim 6 wherein the releasable hook is resiliently biased from the closed position to the open position.

13. The method according to claim 7 further comprising a release plate mechanism that releasably holds the rotatable hook in the closed position.

14. The method according to claim 8 further comprising a release defeat mechanism that prevents release of the rotatable hook by the release plate mechanism.

15. The method according to claim 9 further comprising a rotating safety release attachment ring that is rotatingly attached to the body of the device.

* * * * *